United States Patent [19]

Stevens et al.

[11] Patent Number: 4,539,769

[45] Date of Patent: Sep. 10, 1985

[54] MOUNT FOR ATTACHING A DEVICE TO A FIREARM

[75] Inventors: Frederick G. Stevens, Bridgeport, Conn.; Robert J. Heideman, Livonia; Jerry B. Holden, Plymouth, both of Mich.

[73] Assignee: Hydra Systems International, Inc., Bridgeport, Conn.

[21] Appl. No.: 500,417

[22] Filed: Jun. 2, 1983 (Under 37 CFR 1.47)

[51] Int. Cl.[3] ..... F41C 27/00

[52] U.S. Cl. ..... 42/1 A; 42/1 R

[58] Field of Search ..... 42/1 A, 1 S, 1 R, 1 ST, 42/86, 75 A; 362/110, 111

[56] References Cited

U.S. PATENT DOCUMENTS 4,026,054 5/1977 Snyder ..... 42/1 A 4,212,109 7/1980 Snyder ..... 42/1 A 4,291,478 9/1981 Lough ..... 42/1 A

*Primary Examiner*—Charles T. Jordan

*Attorney, Agent, or Firm*—Frederick H. Rabin; Barry Kramer; Barry R. Lipsitz

[57] ABSTRACT

A mount for attaching a device to a firearm includes a longitudinal base adapted to carry the device to be mounted. The base has a track extending along a portion of the length thereof and a block is slidably mounted in the track. The block is biased toward the front end of the base by a spring. The block is adapted to be attached to a first fixed member at one end of a firearm barrel. The rear end of the base is adapted to be attached to a second fixed member at the other end of the firearm barrel. When properly mounted between the ends of the firearm barrel, the mount is held in place by the action of the spring, which forces the block attachment against the first fixed member and the rear attachment against the second fixed member.

19 Claims, 8 Drawing Figures

MOUNT FOR ATTACHING A DEVICE TO A FIREARM

BACKGROUND OF THE INVENTION

This invention relates to weapons, such as firearms which are laser aimed, and more specifically relates to a mount for attaching a device, such as a laser gunsight, to a weapon.

Laser aiming devices for firearms are well known. Examples of such devices are disclosed in U.S. Pat. Nos. 4,152,754; 4,233,770; 4,313,272; and 4,313,273. In each of the devices disclosed in these patents, it is important that the laser beam emitting device be properly mounted to the firearm in order to obtain accurate aiming. The mounts for the lasers shown in these patents cannot readily be attached and removed from the weapon. It would be advantageous, however, to have a mount which can quickly be attached and detached from the weapon for immediate interchange for use on another weapon or for storage when not in use.

Other considerations are important in providing a means for quickly mounting and detaching a laser gunsight from a weapon. For example, since the combined weight of the weapon and its ammunition becomes critical in combat situations where maneuverability in the field is essential, it is important that any mounting means be lightweight. Further, in order to provide economy and convenience, it would be advantageous to provide a mount which requires no modification to the weapon. Such a mount should also provide adjustment for windage and elevation, enabling the laser gunsight to be removed from the weapon and remounted and still remain properly aligned. Further, there should be no interference with the conventional sights of the weapon, thereby allowing the user an instant choice as to which aiming method is used.

The present invention provides such a mount.

SUMMARY OF THE INVENTION

In accordance with the present invention, a mount for attaching a device to a firearm is provided which comprises a longitudinal base adapted to carry the device to be mounted and having a track extending along a portion of the length thereof. A block is slidably mounted in the track, and spring means is provided for biasing the block toward one end of the base. First means is mounted to the block and adapted to be attached to a first fixed member at one end of a firearm barrel. Second means is provided for attaching the other end of the base to a second fixed member at the other end of the firearm barrel.

The device is mounted by attaching the first means to the first fixed member, sliding the base forward relative to the block until the second means is in a position to be attached to the second fixed member, aligning the second means with the second fixed member, and releasing the mount to cause the base to slide rearward with respect to the block in response to the biasing action of the spring means, thereby engaging the second means with the second fixed member.

Means for providing windage and elevation adjustment can be included on the mount. The second means can comprise a second block containing a notch adapted for mating engagement with a portion of the second fixed member, which may, for example, be a bayonet holder fixed to the firearm. A pair of pivoting lever arms with tabs extending into the notch can be provided, with means for spring loading the tabs in the notch to lock the second means onto the second fixed member.

The mount is particularly suited for mounting a laser gun sight to a conventional weapon.

DETAILED DESCRIPTION OF A PREFERRED EMBODIMENT

Figure 1:
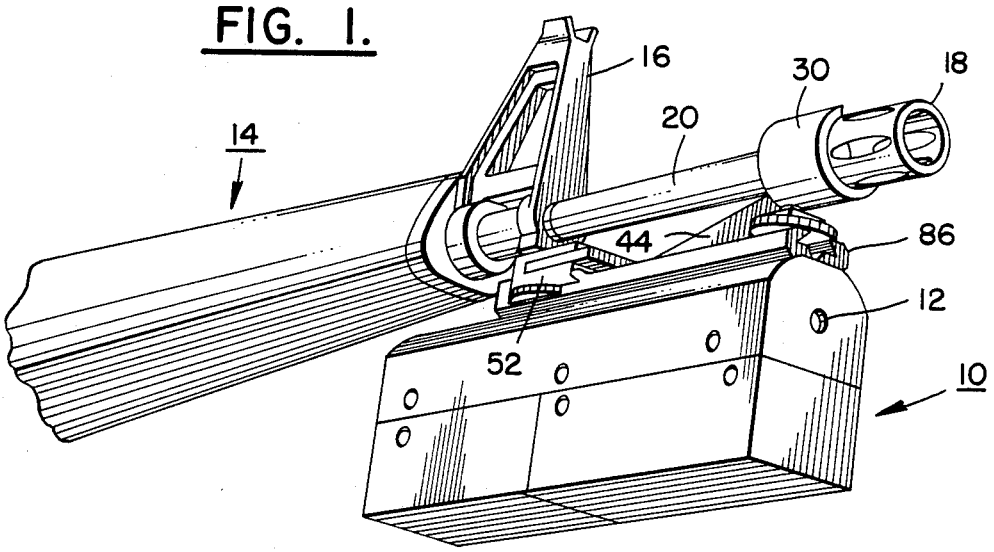
FIG. 1 is a perspective view showing a laser gunsight mounted to a weapon using the mount of the present invention.

As shown in FIG. 1, a laser gunsight generally designated 10 is mounted to weapon 14 using the mount of the present invention. Laser gunsight 10 includes a laser which emits a beam from opening 12 and includes a self-contained power source, such as batteries.

A first means, shown in this embodiment as an open collar 30, encircles one end of the barrel 20 and abuts the rear of a first fixed member, shown in this embodiment as a flash suppressor 18, of weapon 14. A second means, shown as a clip 52, clips to a second fixed member, shown in this embodiment as a bayonet holder 16, of weapon 14, the mount being held in place by a spring force which urges open collar 30 away from clip 52 as explained hereinbelow.

Figure 4:
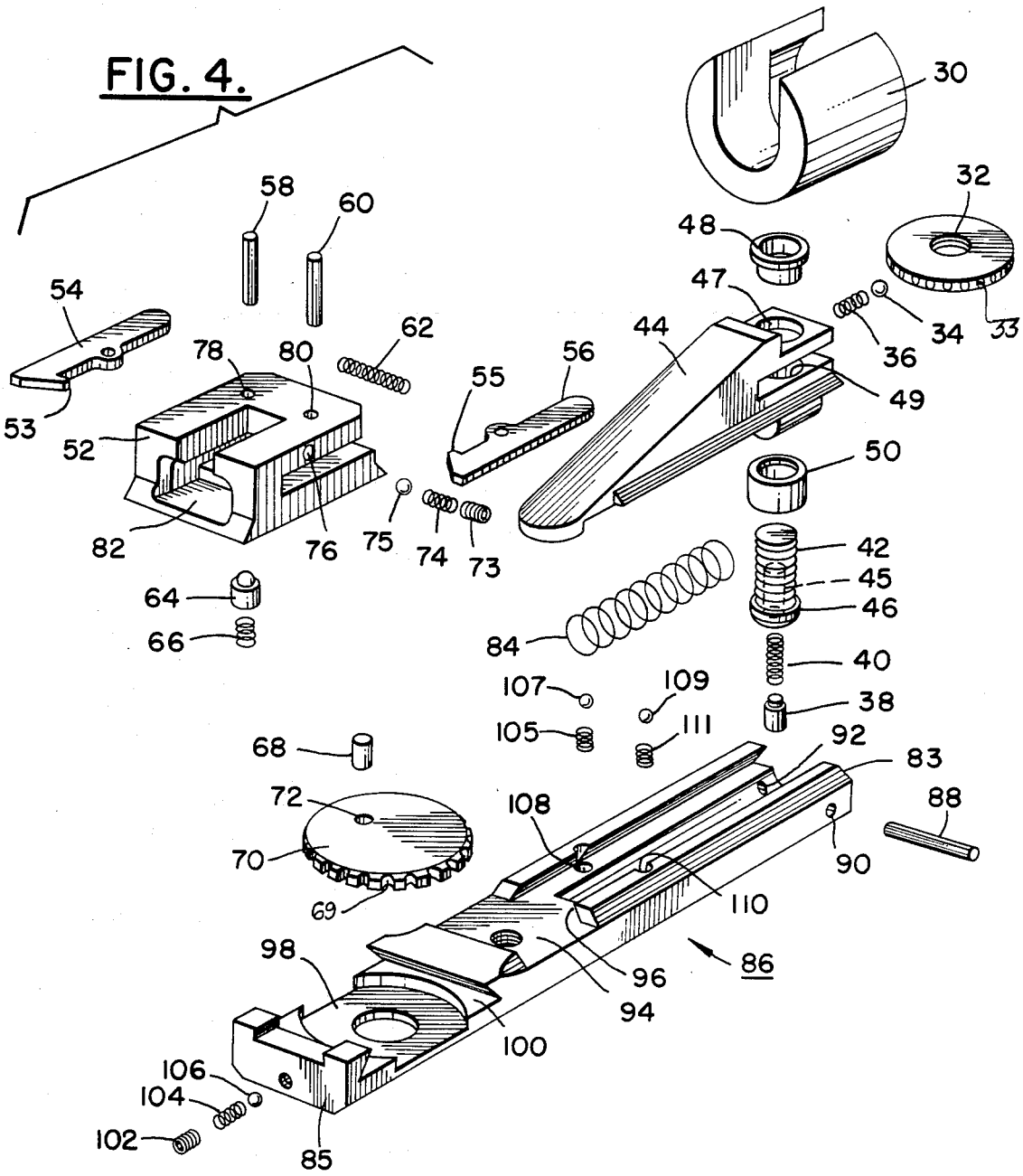
FIG. 4 is an exploded perspective view of the mount of the present invention; Io
Figure 5:
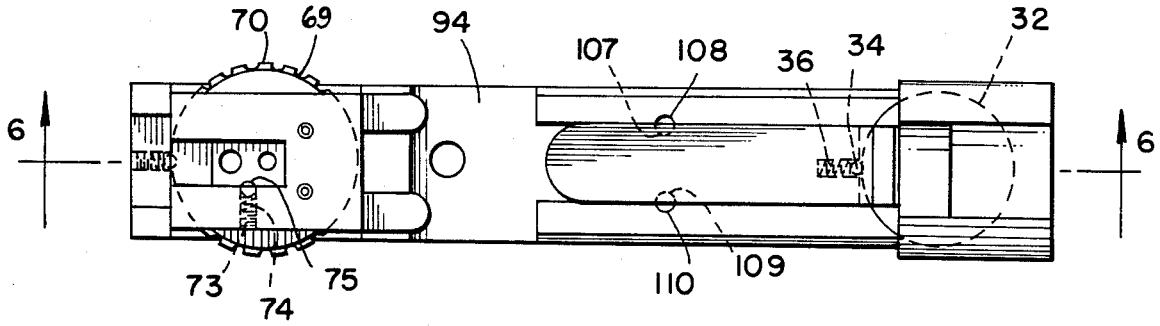
FIG. 5 is a top view of the mount of the present invention.
Figure 6:
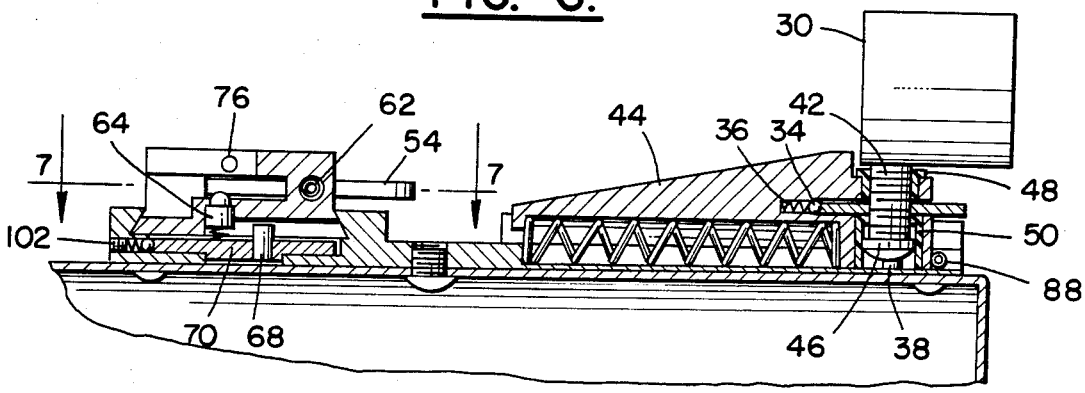
FIG. 6 is a sectional view taken substantially along lines 6—6 of FIG. 5.

Turning now to FIG. 4, each of the parts of the mount of the present invention are shown. Open collar 30 is secured to block 44 by a threaded shaft 42. One end of threaded shaft 42 is tapered outwardly to form a head 46. A bore 45 in threaded shaft 42 is provided for housing a spring 40 which biases a plastic bearing 38. A top bushing 48 is press fit into hole 47 in block 44. A bottom bushing 50 is press fit into hole 49 of block 44. Threaded shaft 42 is pushed from the bottom of block 44 into bottom bushing 50, through top bushing 48, and is screwed into open collar 30. An elevation thumb wheel 32 is sandwiched within block 44 and threadedly engaged with threaded shaft 42. Spring 36 biases ball bearing 34 against the edge of thumb wheel 32, which includes a plurality of detents 33 for accommodating the ball bearing 34, in order to prevent a change in elevation setting due to vibration or other unintended movement of thumb wheel 32. By turning thumb wheel 32 clockwise, open collar 30 is raised with respect to block 44. Turning elevation thumb wheel 32 counterclockwise causes open collar 30 to move closer to block 44. Head 46 on threaded shaft 42 prevents open collar 30 from being raised so much that it separates from block 44. Once head 46 contacts bottom bushing 50, further clockwise movement of thumb wheel 32, and resultant upward movement of open collar 30, will be prevented.

Block 44 slides in a track 96 in base 86 of the mount. A spring 84 biases block 44 toward the front end 83 of base 86. Bores 108 and 110 in base 86 accommodate springs 105, 111 and ball bearings 107, 109 respectively. Springs 105 and 111 bias ball bearings 107 and 109 upwardly against block 44 to compensate for any tolerance variations within block 44 or track 96. A pin 88 is inserted in holes 90, 92 at the front end 83 of base 86 to limit the sliding movement of block 44 and to prevent block 44 from being inadvertently removed from base 86.

A notch 94 is cut in base 86 at the rearward end of track 96. Notch 94 provides a space in which a user can insert his finger to wipe away any mud or other debris that would otherwise collect in track 96 and interfere with the sliding operation of block 44 in base 86.

Figure 2:
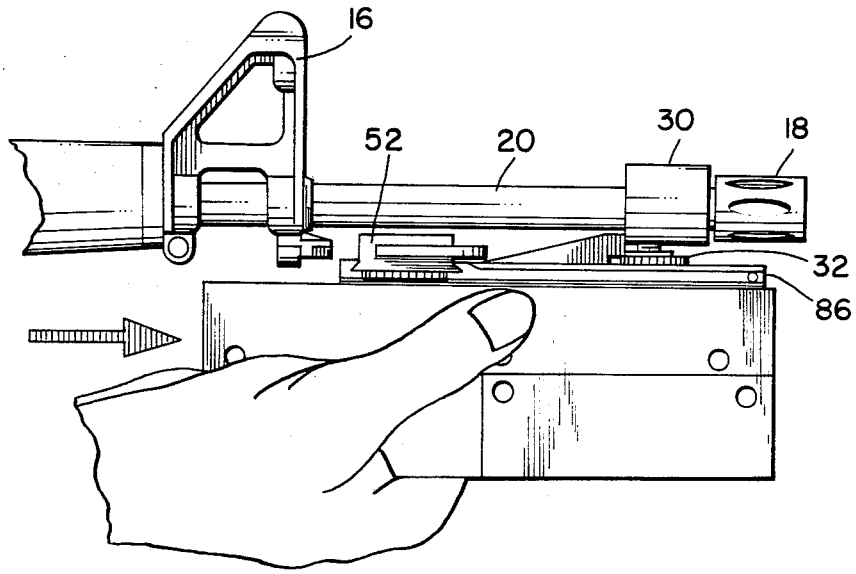
FIG. 2 is a side view of the gunsight as it is being mounted to the weapon.
Figure 3:
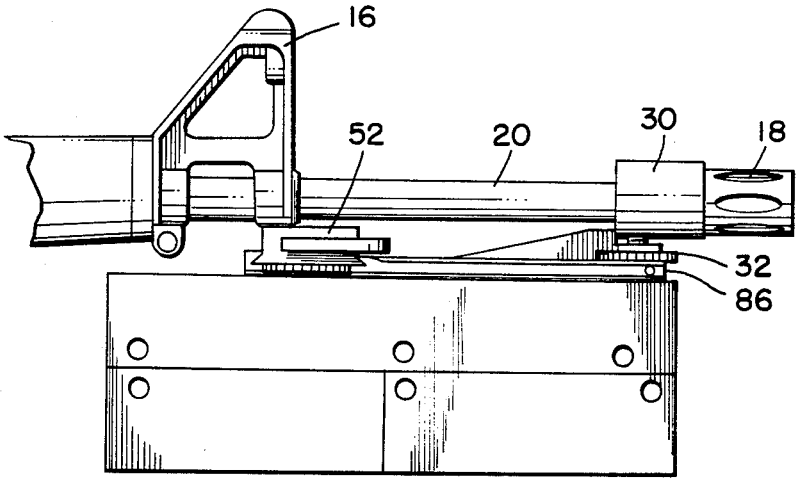
FIG. 3 is a side view of the mounted gunsight.
Figure 7:
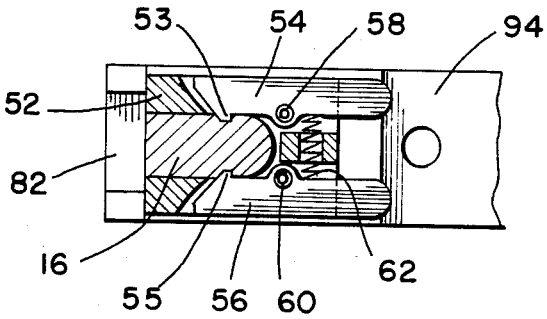
FIG. 7 is a sectional view taken substantially along lines 7—7 of FIG. 6.

Second block, or "clip" 52 is slidably mounted for side to side movement within track 100 of base 86, toward the rear end 85 of base 86. Second block 52 contains a notch 82 adapted for mating engagement with a portion of bayonet holder 16 of a firearm 14 as shown in FIGS. 1–3. A pair of lever arms 54, 56 are pivotally mounted by pins 58 and 60, which are inserted into holes 78, 80 of block 52. Tabs 53 and 55 on lever arms 54 and 56, respectively, extend into notch 82 of second block 52. Spring 62 spring loads tabs 53 and 55 into notch 82 to lock the second block 52 onto the bayonet holder 16 of weapon 14. This locking arrangement is most clearly shown in FIG. 7.

Second block 52 also includes a bore 76 therein, which accommodates a ball bearing 75 biased by a spring 74 which is secured in place by a set screw 73. When second block 52 is locked in place on the bayonet holder 16 of a weapon 14, spring loaded ball bearing 75 serves to compensate for any tolerance variations in slot 82 of second block 52 or in the corresponding portion of the bayonet holder 16.

Figure 8:
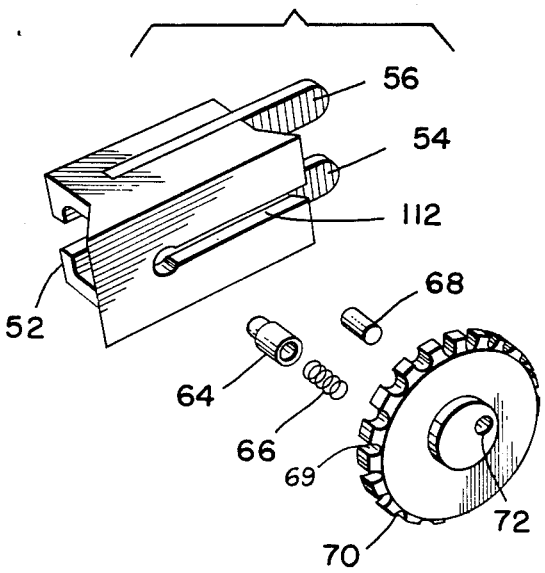
FIG. 8 is a bottom perspective view of the second block of the mount of the present invention.

As noted hereinabove, second block 52 is slidably mounted in track 100 of base 86 for side to side movement. This structure provides for windage adjustment. Windage is the disturbance of air around a moving projectile, such as a bullet. A windage adjustment compensates for the displacement of the bullet by the wind, by slightly shifting the aim of the gunsight. In the present invention, windage adjustment is provided by thumb wheel 70 which has an offset hole 72 for accommodating a pin 68. Thumb wheel 70 fits within circular cut-out portion 98 of base 86. Pin 68 rides in slot 112 of second block 52, as shown in FIG. 8. A bearing 64 biased by pressure spring 66 rides between second block 52 and thumb wheel 70.

In order to assemble the windage adjustment mechanism, thumb wheel 70 is first placed in circular recess 98 of base 86. Second block 52 is then slid into track 100 of base 86. Spring 66 and bearing 64 are sandwiched between second block 52 and thumb wheel 70 as second block 52 is slid into track 100. Guide pin 68 is then pushed through hole 72 from underneath base 86, until guide pin 68 is positioned within slot 112 of second block 52. A set screw 102 holds a spring 104 against ball bearing 106 in rear end 85 of base 86. Ball bearing 106 rides against the edge of thumb wheel 70, which contains a plurality of detents 69, to prevent thumb wheel 70 from moving, and hence the windage adjustment from being affected, by vibration or other movement of the mount.

The placement of mount 10 on a weapon will now be explained with reference to FIGS. 2 and 3. The first step in placing the mount on the weapon is to place open collar 30 about the weapon barrel 20 to abut the rear of flash suppressor 18. Base 86 is then slid forward relative to the flash suppressor 18 and firearm barrel 20 until second block 52 is in a position to be attached to bayonet holder 16. The rear end of base 86 is then pivoted upwardly toward the firearm, and the base is released to cause it to slide rearward with respect to block 44 in response to the biasing action of spring 84, thereby engaging second block 52 to bayonet holder 16.

Although the invention has been described and illustrated with respect to a preferred embodiment thereof, it will be apparent to those skilled in the art that many modifications and changes in the apparatus may be made without departing from the spirit and scope of the invention as defined in the claims appended hereto. For example, a mount in accordance with the present invention can be attached to different types of firearms. If the firearm of interest does not contain a bayonet holder, the mount can be installed between the flash suppressor at the muzzle end of the barrel, and any fixed member, such a bipod attachment, which exists at the other end of the barrel.

For purposes of this disclosure, the "ends" of the firearm barrel are not meant to necessarily be the absolute ends of the tube forming the barrel; rather, while one of the ends of the barrel is generally the muzzle of the firearm, the other one of the ends can, for example, be the portion of the barrel which is adjacent the forestock of the firearm. Depending upon the type of firearm used, a mount in accordance with the present invention can utilize the forestock of the weapon as the "first fixed member" or "second fixed member", with the muzzle end of the barrel, and particularly the flash suppressor mounted thereto, serving as the other "fixed member".

It should be appreciated that the spring biased sliding block arrangement of the present invention can be adapted to attach a wide variety of devices to many different types of firearms.

What is claimed is:

1. A mount for attaching a device to a firearm comprising:

a longitudinal base adapted to carry the device to be mounted and having a track extending along a portion of the length thereof;

a block slidably mounted in said track;

spring means for biasing said block toward one end of said base;

first means mounted to said block for attachment to a first fixed member at one end of a firearm barrel; and second means for attaching the other end of said base to a second fixed member at the other end of the firearm barrel;

whereby the device is mounted by attaching said first means to said first fixed member, sliding the base forward relative to said block until said second means is in a position to be attached to the second fixed member, aligning said second means with said second fixed member, and releasing said mount to cause the base to slide rearward with respect to the block in response to the biasing action of said spring means, thereby engaging said second means with said second fixed member.

2. The mount of claim 1 further comprising means operatively associated with said second means for providing windage adjustment.

3. The mount of claim 2 further comprising means operatively associated with said first means for providing elevation adjustment.

4. The mount of claim 1 further comprising means operatively associated with said first means for providing elevation adjustment.

5. The mount of claim 1 wherein said second means comprises a second block containing a notch adapted for mating engagement with a portion of said second fixed member, a pair of pivoting lever arms with tabs extending into said notch, and means for spring loading said tabs in said notch to lock the second block onto said second fixed member.

6. The mount of claim 5 wherein said second block is slidably mounted for side to side movement within said base, further comprising means for providing windage adjustment by changing the side to side position of the secon block in said base.

7. The mount of claim 6 further comprising means operatively associated with said first means for providing elevation adjustment.

8. The mount of claim 5 wherein said second block is adapted to engage a bayonet holder of a firearm.

9. The mount of claim 8 wherein said first means comprises an open collar adapted to encircle the barrel and abut the rear of a flash suppressor of a firearm.

10. The mount of claim 1 wherein said first means comprises an open collar adapted to encircle the barrel and abut said first fixed member.

11. The mount of claim 1 further comprising a thumb wheel assembly operatively associated with said first means, for providing elevation adjustment, said thumb wheel having a plurality of detents on the edge thereof, and a spring biased bearing adapted to exert a force against the detented edge of said thumb wheel.

12. The mount of claim 11 further comprising a thumb wheel assembly operatively associated with said second means for providing windage adjustment, said thumb wheel having a plurality of detents on the edge thereof, and a spring biased bearing adapted to exert a force against the detented edge of said thumb wheel.

13. The mount of claim 1 further comprising a thumb wheel assembly mounted to said second means for providing windage adjustment, said thumb wheel having a plurality of detents on the edge thereof, and a spring biased bearing adapted to exert a force against the detented edge of said thumb wheel.

14. Apparatus for mounting a laser aiming device to a weapon having a bayonet holder and a barrel mounted flash suppressor comprising:

a base adapted to be mounted to a laser aiming device;

a block slidably mounted to said base;

spring means for biasing said block toward the front end of said base;

an open collar mounted to said block and adapted to encircle the weapon's barrel and abut the rear of the weapon's flash suppressor;

a clip mounted to the rear end of said base and adapted to be clipped to the weapon's bayonet holder;

means for providing a windage adjustment by altering the lateral position of said clip with respect to said base; and means for providing an elevation adjustment by raising or lowering the vertical position of said open collar with respect to said base;

whereby a laser aiming device attached to said base is mounted to the weapon by placing said open collar about the weapon's barrel to abut the rear of the flash suppressor, sliding the base forward relative to the flash suppressor and barrel until said clip is in a position to be clipped to the bayonet holder, pivoting the rear end of said base toward said weapon, and releasing said base to allow it to slide rearward toward said bayonet holder in response to the biasing action of said spring means, thereby latching said clip to said bayonet holder.

15. The mount of claim 14 wherein said windage and elevation adjustment means each comprise:

(i) a thumb wheel having a plurality of detents on the edge thereof, and (ii) a spring biased bearing adapted to exert a force against the detented edge of said thumb wheel.

16. The mount of claim 14 further comprising a plurality of bearings sandwiched between said base and said block, and means for biasing said bearings to compensate for tolerance variations between said base and said slidably mounted block.

17. The mount of claim 14 wherein said clip comprises a second block containing a notch adapted for mating engagement with a portion of the bayonet holder of the weapon, a pair of pivoting lever arms with tabs extending into said notch, and means for spring loading said tabs in said notch to lock the clip onto the bayonet holder.

18. The mount of claim 17 wherein said second block contains means for compensating for tolerance variations between said notch and said mating portion of said bayonet holder.

19. The mount of claim 18 wherein said compensating means comprises a spring loaded bearing mounted within said second block and adapted to exert a force against said mating portion of said bayonet holder.

* * * * *